US008801222B2

(12) United States Patent
Wung et al.

(10) Patent No.: US 8,801,222 B2
(45) Date of Patent: Aug. 12, 2014

(54) LED LAMP

(71) Applicants: Champ Tech Optical (Foshan) Corporation, Foshan (CN); Foxconn Technology Co., Ltd., New Taipei (TW)

(72) Inventors: Shih-Hsun Wung, New Taipei (TW); Wen Xu, Foshan (CN); Peng Huang, Foshan (CN)

(73) Assignees: Champ Tech Optical (Foshan) Corporation, Foshan (CN); Foxconn Technology Co., Ltd., New Taipei (TW)

( * ) Notice: Subject to any disclaimer, the term of this patent is extended or adjusted under 35 U.S.C. 154(b) by 0 days.

(21) Appl. No.: 13/710,484

(22) Filed: Dec. 11, 2012

(65) Prior Publication Data

US 2013/0308314 A1 Nov. 21, 2013

(30) Foreign Application Priority Data

May 17, 2012 (CN) ..... 2012 1 0153423

(51) Int. Cl.
*F21V 21/00* (2006.01)

(52) U.S. Cl.
USPC ..... 362/249.02; 362/294

(58) Field of Classification Search
CPC ..... F21V 29/2268; F21V 29/2293
USPC ..... 362/294, 249.02, 373
See application file for complete search history.

(56) References Cited

U.S. PATENT DOCUMENTS

| | | | | |
|---|---|---|---|---|
| 8,246,215 | B2 * | 8/2012 | Lu et al. | 362/294 |
| 2002/0191396 | A1 * | 12/2002 | Reiff et al. | 362/246 |
| 2008/0285289 | A1 * | 11/2008 | Chen | 362/373 |
| 2011/0164420 | A1 * | 7/2011 | Lee | 362/249.02 |

FOREIGN PATENT DOCUMENTS

DE 202011050152 * 8/2011 ..... F21V 17/00

* cited by examiner

*Primary Examiner* — Evan Dzierzynski
(74) *Attorney, Agent, or Firm* — Novak Druce Connolly Bove + Quigg LLP

(57) ABSTRACT

An exemplary LED lamp includes a heat sink, and an LED module mounted on the heat sink. The heat sink includes a base, a receiving tube extending upwardly from a first face of the base, and a plurality of fins extending outwardly from an outer circumference of the receiving tube. The LED module is mounted a second face of the base. A plurality of through tunnels are defined in the base. The through tunnels extend through the base from the first face to the second face of the base. Each through tunnel communicates with an air passage between two neighboring fins.

16 Claims, 4 Drawing Sheets

LED LAMP

BACKGROUND

1. Technical Field

The disclosure relates to LED (light emitting diode) lamps for illumination purpose and, more particularly, relates to an improved LED lamp having a good heat dissipation.

2. Description of Related Art

LEDs have many beneficial characteristics, including low electrical power consumption, low heat generation, long lifetime, small volume, good impact resistance, fast response and excellent stability. These characteristics have enabled the LEDs to be widely used as a light source in electrical appliances and electronic devices.

An LED lamp generally requires a plurality of LEDs mostly driven at the same time, which results in a rapid rise in operating temperature of the LEDs. However, since the lamps lack effective heat dissipation mechanisms, continuous operation of the LED lamps can cause overheat of the LEDs, resulting in flickering or even malfunction of the LEDs.

What is needed, therefore, is an improved LED lamp which overcomes the above described shortcomings.

DETAILED DESCRIPTION

An embodiment of an LED lamp in accordance with the present disclosure will now be described in detail below and with reference to the drawings.

Figure 1:
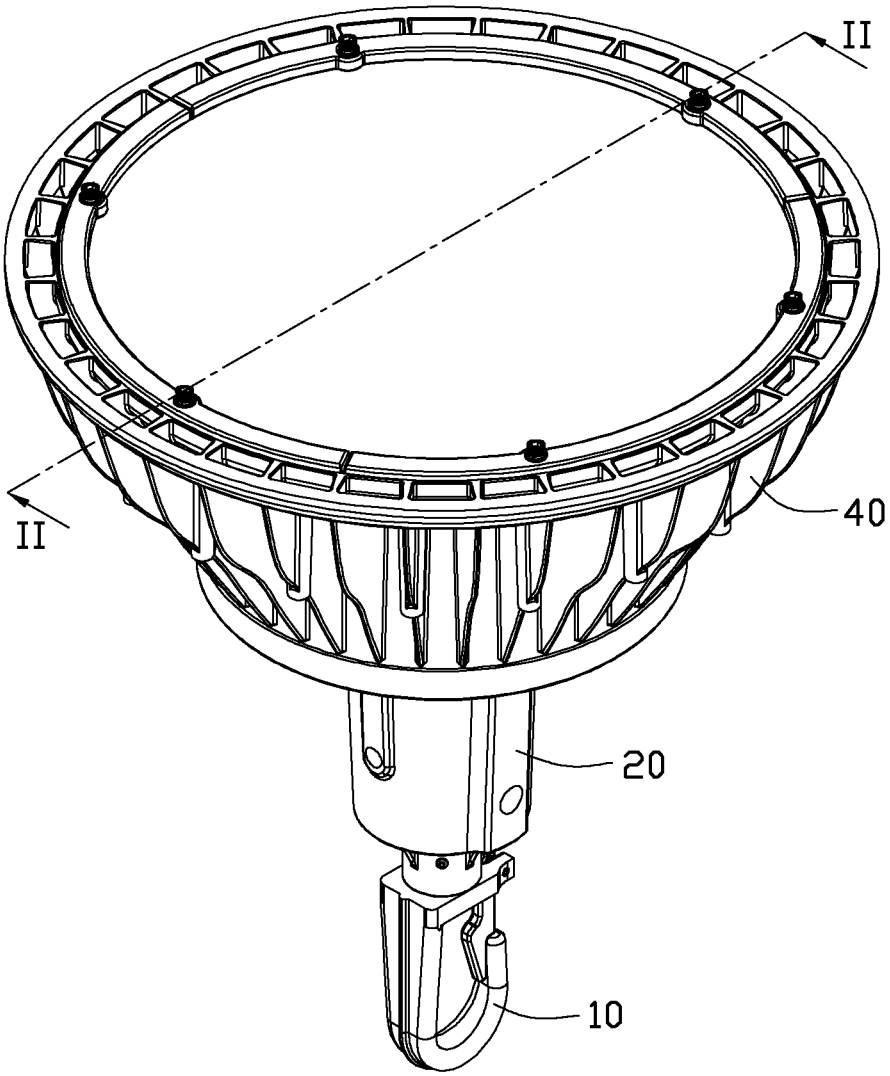
FIG. 1 is an isometric, assembled view of an LED lamp according to an exemplary embodiment of the present disclosure.
Figure 2:
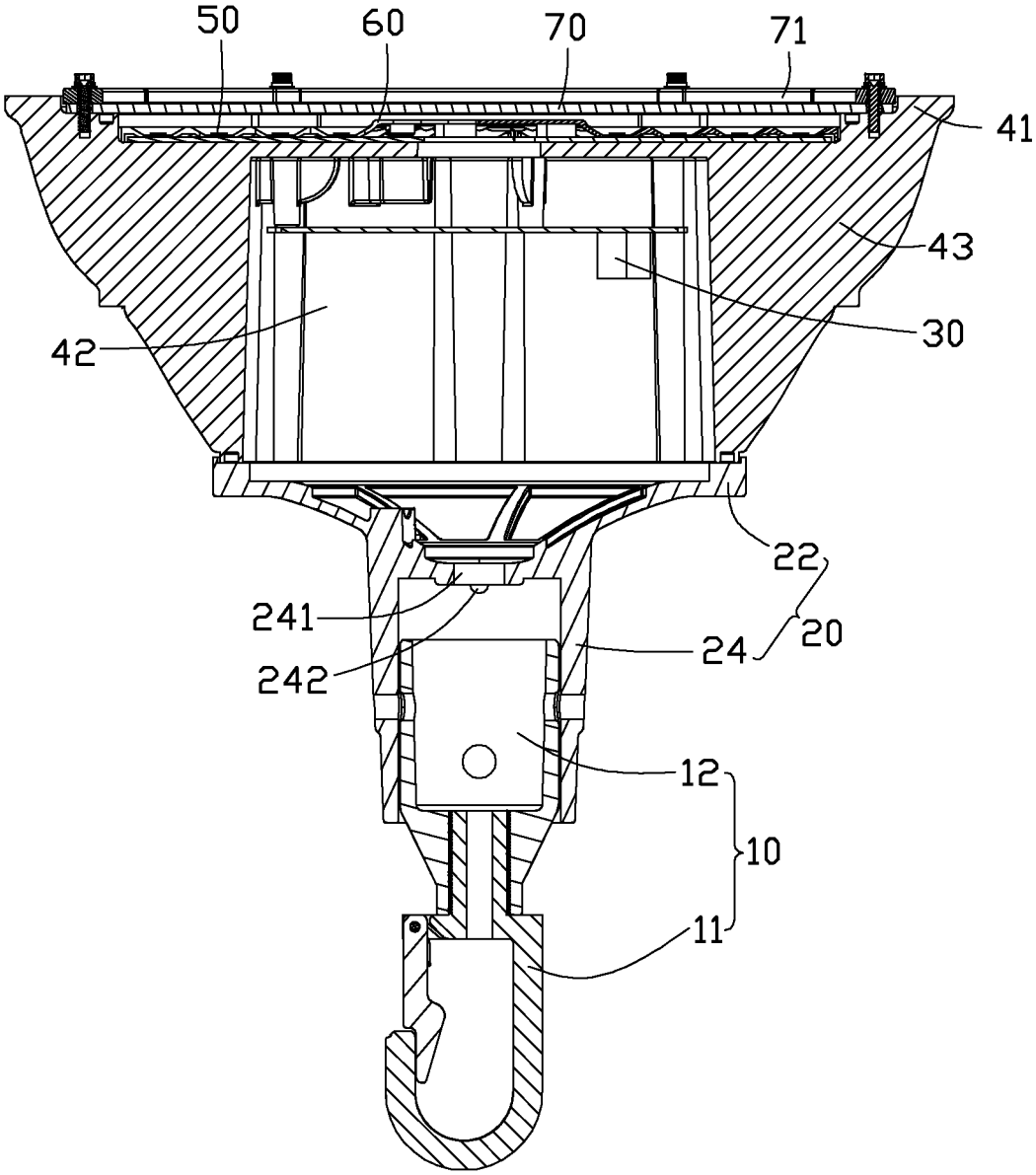
FIG. 2 is a cross-sectional view of the LED lamp of FIG. 1, taken along line II-II thereof.

Referring to FIGS. 1 and 2, an LED lamp in accordance with an exemplary embodiment of the disclosure is illustrated. The LED lamp comprises a mounting member 10, a connecting member 20, a driving module 30, a heat sink 40, an LED module 50 thermally attached to a bottom face of the heat sink 40, a light-guiding member 60 located on the bottom face of the heat sink 40, an envelope 70 mounted on the heat sink 40 and correspondingly covering the LED module 50, and a pressing frame 71 securing the envelope 70 to the heat sink 40.

Figure 3:
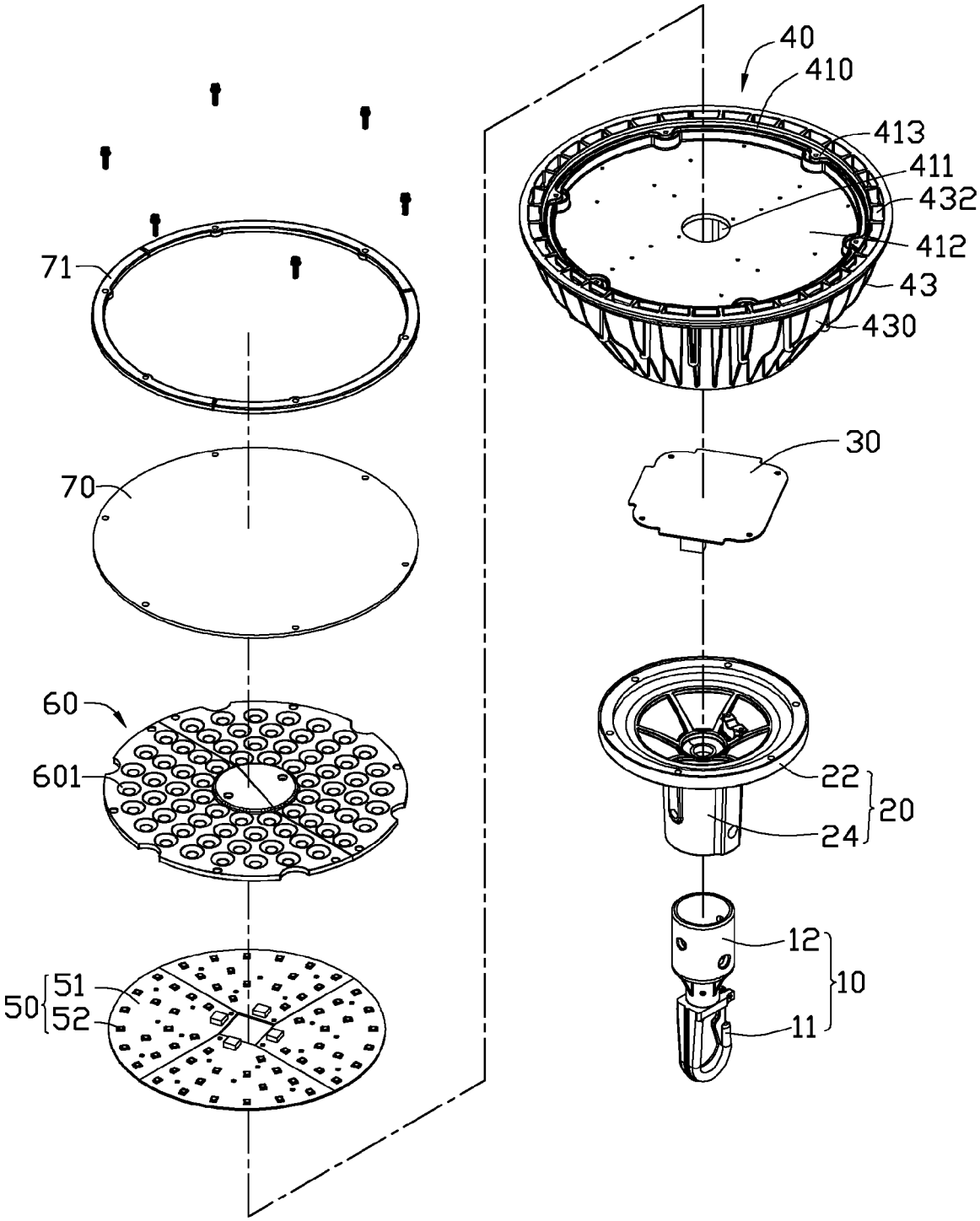
FIG. 3 is an exploded view of the LED lamp of FIG. 1.
Figure 4:
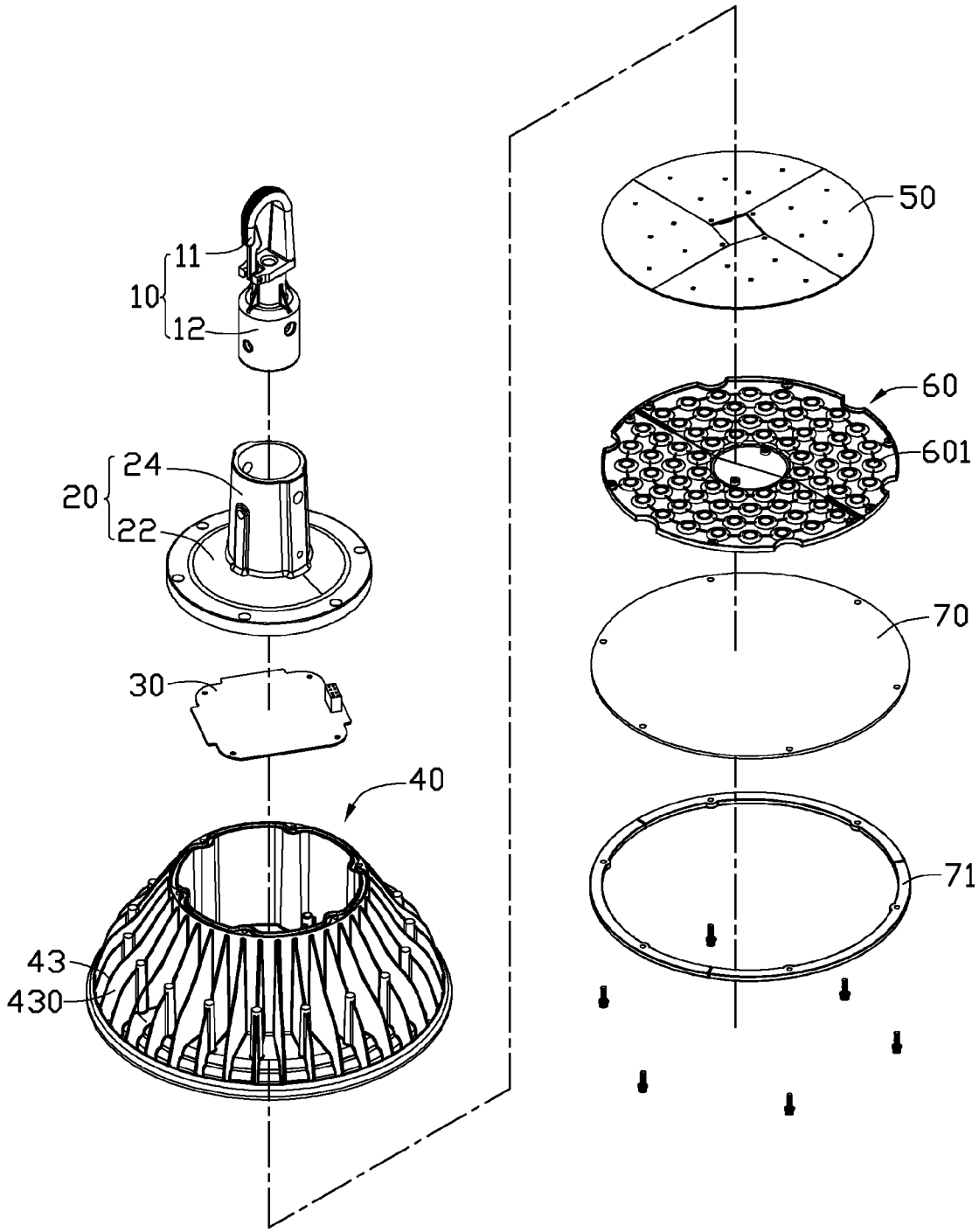
FIG. 4 is an inverted, exploded view of the LED lamp of FIG. 1.

Referring to FIGS. 3 and 4 also, the heat sink 40 is integrally made of a metal with good heat conductivity such as aluminum, copper or an alloy thereof. The heat sink 40 comprises a circular base 41, a receiving tube 42 extending upwardly from a top face of the base 41, and a plurality of fins 43 extending outwardly from an outer circumference of the receiving tube 42. A central area of a bottom face of the base 41 is depressed inwardly, whereby an annular mounting portion 410 is formed along an outer periphery of the bottom face of the base 41, and a circular receiving portion 412 is defined at the central area of the base 41 and surrounded by the mounting portion 410. The LED module 50 is correspondingly mounted on the receiving portion 412. A through hole 411 is defined in a center of the receiving portion 412 of the base 41 for extension of electrical wires (not shown) therethrough to electrically connect with the LED module 50. The envelope 70 is mounted on the bottom face of the base 41 with a periphery of the envelope 70 engaging with the mounting portion 410 so that the envelope 70 is hermetically connected to the base 41 of the heat sink 40. A plurality of protruding ribs 413 protrude inwardly and perpendicularly from an inner circumference of the mounting portion 410. The protruding ribs 413 are equally spaced from each other. The protruding ribs 413 each have a semicircular cross-section along a horizontal direction. A screw hole (not labeled) is defined in a central of each protruding rib 413.

The fins 43 are spaced from each other. The fins 43 are arranged radially relative to the receiving tube 42. A passage 430 is defined between every two neighboring fins 43. The fins 43 directly connect to the top face of the base 41.

A plurality of through tunnels 432 are defined in the base 41. Each of the through tunnels 432 extends through the base 41 and has two openings (not labeled) at the bottom face and the top face of the base 41, respectively. The through tunnels 432 are arranged along the mounting portion 410 of the base 41. The through tunnels 432 are arranged radially relative to the receiving portion 412 and the receiving tube 42. The openings of the through tunnels 432 which are located at and exposed from the bottom face of the base 41 are arranged along the mounting portion 410 of the base 41. The openings of the through tunnels 432 which are located at and exposed from the top face of the base 41 surround the receiving tube 42. Each of the openings of the through tunnels 432, which is located at the top face of the base 41, is located correspondingly between two adjacent fins 43. In other words, each of the through tunnels 432 is aligned with and directly communicated with a corresponding passage 430 of the fins 43. It could be understood that, each of the through tunnels 432 is straight or expanded from the top face to the bottom face the of the base 41. The through tunnels 432 are located adjacent an outer periphery of the base 41.

The connecting member 20 comprises a cover 22 hermetically connected to the receiving tube 42, and a connecting tube 24 extending perpendicularly from the cover 22. The receiving tube 42 cooperates with the cover 22 to define a receiving chamber (not labeled) for accommodating the driving module 30 therein. The connecting member 20 further comprises a protecting potion 241 located at a center of the connecting tube 24 for protecting the driving module 30 from moisture and dust. The protecting potion 241 defines a protecting hole 242 at a center thereof for electrical wires to extend therethrough to connect with the driving module 30. The mounting member 10 comprises a hook 11 and a fixing portion 12 connected to the hook 11. The fixing portion 12 is inserted into and fixed to the connecting tube 24 of the connecting member 20. In use, the LED lamp can be fixed to a wall or a ceiling via the hook 11 of the mounting member 10, whereby the LED lamp is inverted from the position shown in FIGS. 1-2. Thus, light generated by the LED module 50 can radiate downwardly through the light guide member 60 and the envelope 70 to illuminate an intended object.

The LED module 50 comprises a circular printed circuit board 51 and a plurality of LEDs 52 mounted on the printed circuit board 51. The printed circuit board 51 is attached to the receiving portion 412 of the heat sink 40 and thermally connects therewith, whereby heat generated by the LEDs 52 can be effectively absorbed by the heat sink 40. The LEDs 54 are arranged evenly on the printed circuit board 51 and spaced from each other. It is understood that the printed circuit board 51 is a supporting fixture which can support the LEDs 52 and electrically connect the LEDs 52 to a power supply.

The light-guiding member 60 defines a plurality of tapered cavities 601 in which the LEDs 52 of the LED module 50 are extended and received, whereby when the LEDs 52 are activated, a part of light emitted from the LEDs 52 is able to emit to outside directly, and the remaining part of the light is first reflected by inner faces of the cavities 601 and then emits to the outside to thus obtain a satisfactory illumination pattern. In other words, the light-guiding member 60 functions as a secondary optical element for the LEDs 52.

The envelope 70 is integrally formed of a transparent or semitransparent material such as glass, resin or plastic. The pressing frame 71 is annular and defines a hole (not labeled) at a center thereof. A plurality of spaced protruding tabs (not labeled) extend radially and outwardly from an outer periphery of the pressing frame 71. The pressing frame 71 has a diameter substantially equal to that of the envelope 70. Each of the protruding tabs defines a securing hole (not labeled) at a center thereof. Fasteners (not labeled) are brought to extend through the securing holes and threadedly engage in the protruding ribs 413 to thereby secure the pressing frame 71 to the heat sink 10, whereby the envelope 70 is also securely mounted to the heat sink 40.

When the LED module 50 works, heat generated by the LEDs 52 is absorbed by the heat sink 40, and then the heat is dispersed into ambient air via the fins 43. The tunnels 432 communicate the bottom face of the base 41, the top face of the base 41 and the passages 430, whereby the heat generated by the LEDs 52 can be more easily dissipated to the surrounding air of the LED lamp in accordance with the present disclosure, since a natural heat convection can be more easily formed through the heat sink 40 when the LED lamp is activated to emit light.

It is to be further understood that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. An LED lamp comprising:

a heat sink comprising a base comprising a first face and a second face opposite to the first face, a receiving tube extending upwardly from the first face of the base, and a plurality of fins extending outwardly from an outer circumference of the receiving tube, the fins directly connecting to the first face of the base;

an LED module mounted on a second face of the base; and a plurality of through tunnels defined in the base and extending through the base from the first face to the second face of the base.

2. The LED lamp as described in claim 1, wherein the fins are spaced from each other, and an airflow passage is defined between every two adjacent fins.

3. The LED lamp as described in claim 1, wherein each of the through tunnels is aligned with and directly communicated with a corresponding airflow passage.

4. The LED lamp as described in claim 1, wherein the through tunnels are spaced from each other.

5. The LED lamp as described in claim 1, wherein the through tunnels are located adjacent an outer periphery of the base.

6. The LED lamp as described in claim 5, wherein the through tunnels each expand from the first face to the second face of the base.

7. The LED lamp as described in claim 1, wherein a central area of the second face of the base is depressed inwardly, whereby an annular mounting portion is formed along an outer periphery of the second face of the base, and a receiving portion is defined at the central area of the second face of the base.

8. The LED lamp as described in claim 7, wherein the through tunnels are arranged along the mounting portion.

9. The LED lamp as described in claim 7 further comprising an envelope mounted on the mounting portion, and the envelope cooperates with the receiving portion to enclose the LED module therein.

10. The LED lamp as described in claim 7, wherein the through tunnels are arranged radially relative to the receiving portion.

11. The LED lamp as described in claim 7, wherein the fins are arranged radially relative to the receiving tube.

12. The LED lamp as described in claim 1, wherein the heat sink is integrally made of a metal with good heat conductivity.

13. An LED lamp comprising:

a heat sink comprising a base having a first face and a second face opposite to the first face, a receiving tube extending upwardly from the first face of the base, and a plurality of fins extending outwardly from an outer circumference of the receiving tube, a central area of the second face of the base being depressed inwardly, whereby an annular mounting portion is formed along an outer periphery of the second face of the base, and a receiving portion is defined at the central area of the second face of the base, the fins being arranged radially relative to the receiving tube;

an LED module mounted the second face of the heat sink; and a plurality of through tunnels defined in the heat sink and extending through the heat sink from the first face to the second face of the heat sink.

14. The LED lamp as described in claim 13, wherein the fins are spaced from each other, an airflow passage is defined between every two adjacent fins, and each of the through tunnels is aligned with and directly communicated with a corresponding passage.

15. The LED lamp as described in claim 13, wherein the through tunnels are located adjacent an outer periphery of the heat sink.

16. The LED lamp as described in claim 13 further comprising a hook configured for mounting the LED lamp to a mounting structure, the hook being positioned distant from the LED module.

* * * * *